United States Patent [19]

Nakamura et al.

[11] 4,132,393

[45] Jan. 2, 1979

[54] APPARATUS FOR COOLING HOT STEEL PLATE AND SHEET

[75] Inventors: Shoji Nakamura; Yasuyuki Nakamoto; Youshun Yamamoto; Akira Matsufuji; Takashi Haji, all of Kitakyushu; Akihiro Nakama, Ooita, all of Japan

[73] Assignee: Nippon Steel Corporation, Tokyo, Japan

[21] Appl. No.: 810,475

[22] Filed: Jun. 27, 1977

[30] Foreign Application Priority Data

Jun. 30, 1976 [JP] Japan ..... 51-77162
Aug. 31, 1976 [JP] Japan ..... 51-104087

[51] Int. Cl.[2] ..... L21D 9/00
[52] U.S. Cl. ..... 266/117; 72/201; 266/113
[58] Field of Search ..... 72/201; 266/113, 114, 266/117

[56] References Cited

U.S. PATENT DOCUMENTS 3,423,254 1/1969 Safford et al. ..... 266/113 X
3,604,696 9/1971 Coleman et al. ..... 266/102

*Primary Examiner*—Howard N. Goldberg
*Assistant Examiner*—Paul A. Bell

[57] ABSTRACT

An apparatus for cooling hot steel plate and sheet has a plurality of cooling units disposed along the plate or sheet delivery line. Each cooling unit has a top and a bottom roll-and-nozzle assembly and a device for coupling them. The top and bottom assemblies each have a roll to restrain the plate or sheet and a nozzle to spray a coolant thereon. The coupling device has a screwdown mechanism to adjust the space between the top and bottom rolls and a device for adjusting the restraining force working on the plate or sheet being cooled. This cooling apparatus permits rapid cooling of steel plate and sheet without causing distortion thereof, and the apparatus is easy to maintain.

6 Claims, 10 Drawing Figures

APPARATUS FOR COOLING HOT STEEL PLATE AND SHEET

BACKGROUND OF THE INVENTION AND PRIOR ART

This invention relates to apparatus for cooling hot steel plate and sheet, and more particularly to apparatus for rapidly cooling hot steel plate and sheet while preventing distortion of the plate or sheet.

As is well known, in rolling steel plate and sheet, such as in a plate-mill plant, rolled hot plates are generally flattened in a hot leveler, allowed to cool naturally in the air while traveling over cooling beds, and are delivered to shearing and inspection lines. This air-cooling method requires several hours for cooling the as-rolled plate to approximately ambient temperature, though the time required varies somewhat with the initial or finishing temperature, plate thickness and cooling conditions.

The productivity of modern plate mills has been improved so much that each mill manufactures 200,000 to 300,000 tons of plate per month. To handle such large tonnages by the conventional cooling method necessitates cooling beds having a huge area. The time from rolling to shearing becomes prolonged. Further, since the cooling time is not controllable, it becomes difficult to quickly match the flow of plates to the line speeds of the subsequent shearing and inspection sections. All these factors have caused the productivity of the entire plate-mill plant to remain lower than is desirable.

Recently, the noise produced by the cooling beds and scratches on the plates caused by the cooling beds have also been presenting problems. A change from a grid type conveying system to a walking-beam type system has increased the cost of the cooling bed. As a consequence, it has become the practice in recent years to first air-cool plates to approximately 600° C., the temperature below which the properties of the steel will not change even if it is subjected to rapid cooling, on cooling beds, then cool them to a lower temperature by use of a suitable coolant. But no full-fledged equipment for this process has been provided. However, roller-press quenching equipment, conventionally used for quenching steel plates, is similar to rapid cooling equipment for cooling steel plate. This roller-press quenching equipment comprises oppositely disposed top and bottom rollers and nozzles oppositely disposed between the rollers for spraying cooling water. This equipment is normally directly connected with a reheating furnace to quench the reheated plates. It is capable of treating only relatively well-shaped plates, has a low productivity, and is unsuitable for an in-line cooling unit because of the following drawbacks.

In the conventional quenching equipment, the top pressing rollers are all attached to a top frame so that they move up and down in conjunction therewith. Therefore, if a plate having a distortion at its head or trailing end enters the unit, the plate may cause the frame to tilt and thus cause some of the rollers to separate from the top surface of the plate. As a result, the thickness and, therefore, the temperature of a layer of cooling water on the plate becomes uneven. This impairs the control of cooling rates between the top and bottom plate surfaces, and makes it impossible to produce plates of satisfactory shape. In addition, the fixed frame of this equipment, which carries a roller-height adjusting mechanism, integrally contains the top frame that is moved up and down as well as the rollers attached to the top frame. It is therefore practically impossible to detach the top roll unit from the rest of the machine. Accordingly, a serviceman has to slip between the top and bottom rollers for maintaining and repairing the rollers and nozzles. Likewise, roller and nozzle changing operations are inefficient since the rollers etc. can be disassembled from the remainder of the apparatus and these parts reassembled with the apparatus only sideways.

As long as this equipment is used off line and directly connected with the reheating furnace, its operating and failure rates remain low, and the aforementioned problems are not very acute. Lately, however, direct quenching equipment for directly treating rolled plates and cooling equipment replacing the cooling bed have been put into practical use. These uses, however, involve bent materials, temperature variations and severe operating conditions. These systems are required to have a high operating speed and productivity so as to match well with the capacity of modern rolling mills. The operating rate thereof is also increased greatly. Therefore, high reliability and maintainability are essential. Particularly the in-line type equipment is subjected to preventive maintenance that comprises regular disassembly and checking. Therefore, the conventional equipment which is difficult to disassemble is not well suited for in-line use.

Further, the in-line equipment must be designed so as to permit the threading therethrough of plates which require no cooling. It is then preferable to lift the top rollers to a given height and keep them at the elevated position, from the standpoint of vibration and noise control and energy saving. In such a case, the bottom rolls, which are used more, are apt to wear faster than the top rolls. In the conventional equipment, in which the plate is restrained from top and bottom, plate scratches due to the speed difference between the top and bottom rolls and roll wear due to slippage relative to the plate are furthered. Also, in such equipment, in which the mechanically interlocked top and bottom rolls are driven, it is difficult to stop only the top rolls or adjust the speed difference between the top and bottom rolls.

The conventional roller-press quenching equipment has a mechanism for pressing the plate to restrict its distortion during cooling to a certain extent. The pressure is adjusted by the amount of compression of a spring interposed between a screwdown device and a support frame. The pressure is established, for instance, by the amount by which the roll is raised when the plate enters the space between the rolls, i.e. the amount of spring compression, and the spring constant, the roll spacing being set at a dimension smaller than the thickness of the plate being treated. One such unit is designed to produce a maximum pressure of 110 tons when the roll rises 18mm, a value set in relation to the plate thickness. As will be understood, great pressure will not be obtained unless the roll spacing is made sufficiently smaller than the plate thickness. But a decreased roll spacing tends to inhibit the entry of the plate. From the standpoint of restraining pressure, the spring cannot be compressed too much. Therefore, if any extraordinary plate distortion occurs during cooling, an excess load is imposed on the rolls and other parts of the apparatus because the amount of rise of the rolls, i.e. the amount of compression of the springs, is limited. As a consequence, bending or breakage of the rolls may occur.

When roller-press quenching equipment is used for its original purpose of quenching, reheated plates cut to specified sizes are fed thereto. Even if the plate width changes, therefore, the center line of the quenching equipment always serves as a reference line for feeding of the plates through the equipment, thus permitting application of uniform pressure throughout the entire plate width.

But when the equipment is used as an in-line forced cooling unit as a substitute for a cooling bed in the low temperature region of the cooling of rolled plate, it is placed in a suitable position preceded by a cooling bed and generally followed by shearing equipment. Accordingly, the edge of the plate must be used as the feeding reference line. However, the plate width varies extensively; sometimes plates narrower than a half of the length of the restraining roll are treated. When pressing the plate with the restraining rolls, the roll spacing usually is set somewhat smaller than the plate thickness, and the pressing force is applied by way of an elastic body, e.g. a spring in conventional roller-press quenching equipment. When the plate enters the space between the rolls, therefore, the top roll rises to make the spacing equal to the plate thickness. In the conventional spring-supported roller-press quenching equipment, the pressing force at the opposite ends of the rolls is set to be equal. Therefore, when feeding narrower plates, especially those having widths which are smaller than a half of the roll length, the top roll is inclined around the edge of the plate near the middle of the roll, and the roll is incapable of imposing a uniform appropriate pressure throughout the entire width of the plate. When the roll is inclined, a gap occurs between the top surface of the plate and the bottom suface of the roll. Further, this gap changes over the width of the plate, which in turn varies the cooling water flow and water-film discharging conditions in the direction of the width of the plate and, thereby, prevents uniform cooling. Such uneven cooling may result in undesirable plate deformation. In the as-rolled plates having inherent deformation, this phenomenon becomes especially pronounced.

To solve this problem, either the plate or the cooling equipment must be shifted so that the plate is always passed along the center of the cooling equipment. But such equipment will naturally be costly.

For convenience of maintenance, it is also desirable that the in-line cooling equipment be so constructed as to permit the disassembly of the top frame with ease. Or it is preferably made up of a plurality of units that can be readily replaced. The restricting force, however, is imposed mainly by the weight of the top roll unit elevating member. It is therefore very difficult to provide a restraining force adjusting device in such a position that a uniform restraining force can be imposed on the front and rear and the right and left of the plate, i.e. over the entire area of the plate, due to the size of the roll unit, the position of the drive unit and cooling piping, and other reasons. If the widthwise restraining force becomes non-uniform, the plate may walk out of the cooling water spray range, thus causing unbalanced cooling, thus producing deformed plates.

As is evident from the above description, there has been no high-speed cooling equipment that can be installed in line with a plate-rolling mill. Also, utilization of the conventional roller-press quenching equipment involves the aforementioned problems.

OBJECTS AND BRIEF SUMMARY OF THE INVENTION

An object of this invention is to provide apparatus for cooling hot steel plate and sheet that is capable of performing high-speed one-pass cooling matched with the rolling speed of a rolling mill, even on such materials that have distortion at the head or tail end, by flattening them into a suitable shape.

Another object of this invention is to provide apparatus for cooling hot steel plate and sheet which apparatus is easy to maintain and is highly reliable and having readily detachable top, or top and bottom, roll assemblies.

Still another object of this invention is to provide apparatus for cooling hot steel plate and sheet that permits efficient energy-saving, speed difference correction between the top and bottom rolls, reduction in roll wear, and production of high-quality products.

Yet another object of this invention is to provide apparatus for cooling hot steel plate and sheet that ensures satisfactory entry of the plate or sheet between the top and bottom rolls and imposes a uniform restraining force on the plate or sheet being handled.

To achieve these objects, the apparatus for cooling hot steel plate and sheet according to this invention comprises a plurality of cooling units disposed along the plate or sheet delivery line. Each cooling unit comprises a top and a bottom roll-and-nozzle assembly and a device for coupling them. The top and bottom assemblies each have a roll to restrain the plate or sheet and a nozzle to spray a coolant thereon. The coupling device has a screwdown mechanism to adjust the space between the top and bottom rolls and a device for adjusting the restraining force working on the plate or sheet being cooled.

DESCRIPTION OF THE PREFERRED EMBODIMENTS

Figure 1:
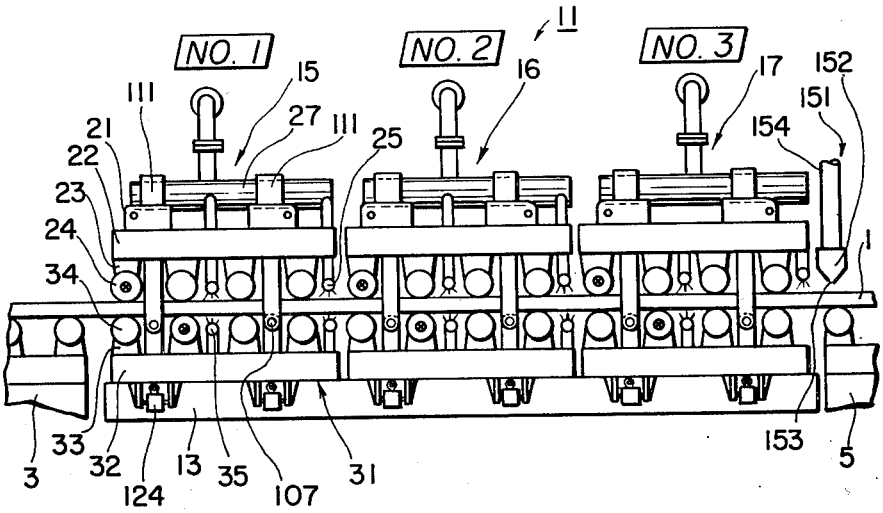
FIG. 1 is a side elevation of the apparatus for cooling hot steel plate and sheet according to this invention.

Apparatus for cooling hot steel plate and sheet according to this invention is specially devised to be located between a finishing mill and shearing equipment in a plate-mill plant. As illustrated in FIG. 1, the cooling apparatus 11 is located between an entry-side roller table 3 extending from the finishing mill (not shown) and an exit-side roller table 5 extending to the shearing equipment (not shown).

Figure 2:
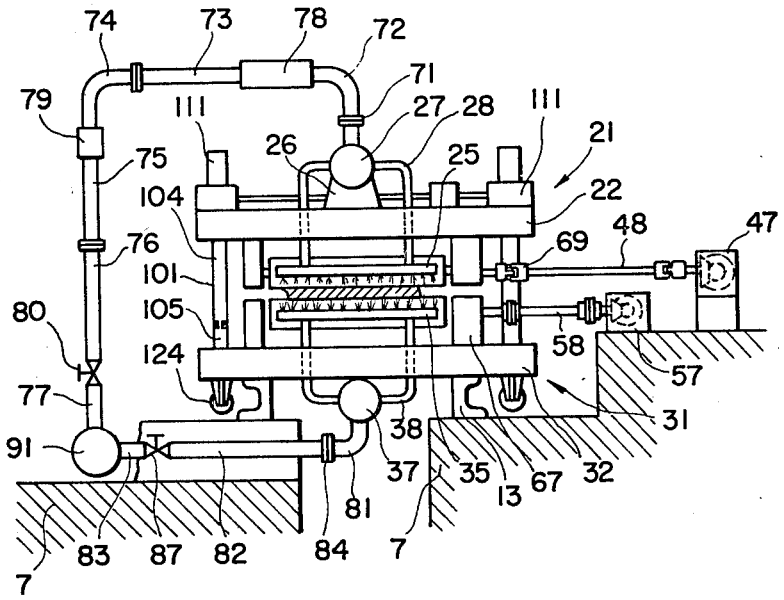
FIGS. 2 and 3 are a front and a plan view, respectively, of the apparatus shown in FIG. 1.

As shown in FIGS. 1 and 2, a pair of sole plates 13 are fixed on the floor 7 between the entry-side roller table 3 and exit-side roller table 5 and parallel to the delivery line of the plate 1.

In this embodiment, the cooling apparatus 11 has three cooling units 15, 16 and 17 disposed along the delivery line of the plate 1 as shown in FIG. 1. Each cooling unit comprises a top roll-and-nozzle assembly 21 and a bottom roll-and-nozzle assembly 31.

The top roll-and-nozzle assembly 21 contains a plurality of spaced bearings 23, for example four sets in this embodiment, fixed to the bottom of a top frame 22 along the plate delivery line. Each pair of bearings 23 has a top roll 24 rotatably supported therein and extending across the delivery line. The top assembly 21 also has a plurality of downwardly directed top nozzles 25 which are provided on a pipe extending across the plate delivery line between the contiguous top rolls 24. A header 27 is mounted on a stand 26 on the top frame 22. The header 27 and said top nozzles 25 are connected by branch pipes 28.

The bottom roll-and-nozzle assembly 31 is identical to the top assembly 21 in construction. Each bottom roll 34 is rotatably supported by a pair of bearings 33 above a bottom frame 22. Upwardly directed bottom nozzles 35 are provided between the adjacent bottom rolls 34. The bottom nozzles 35 communicate through branch pipes 38 with a header 37.

The top and bottom assemblies 21 and 31 are symmetrically coupled together. The bottom frame 32 of the bottom assembly 31 is detachably mounted on said sole plates 13 by bolts or other fastening means. The top assembly 21 is mounted on the bottom assembly 31, and both assemblies are coupled together by coupling devices 101. The top and bottom rolls 24 and 34 are then positioned so as to restrain the plate 1, and the top and bottom nozzles 25 and 35 are opposed to each other.

Figure 4:
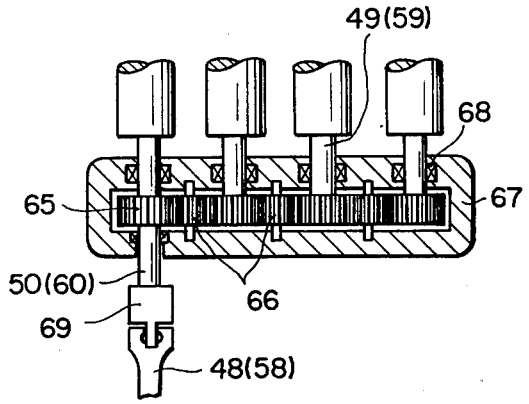
FIG. 4 is a plan view of a roll drive section of the apparatus of FIG. 1.

As shown in FIG. 4, roll necks 49 and 59 of the rolls 24 and 34 in each assembly have gears 65 mounted thereon, and these gears and intermediate gears 66 meshed between gears 65 are contained in a gear box 67, through which only one roll shaft 50 or 60 extends outwards and is connected with an external drive unit 41 through a flexible coupling 69. Reference numeral 68 designates a roll bearing.

Figure 3:
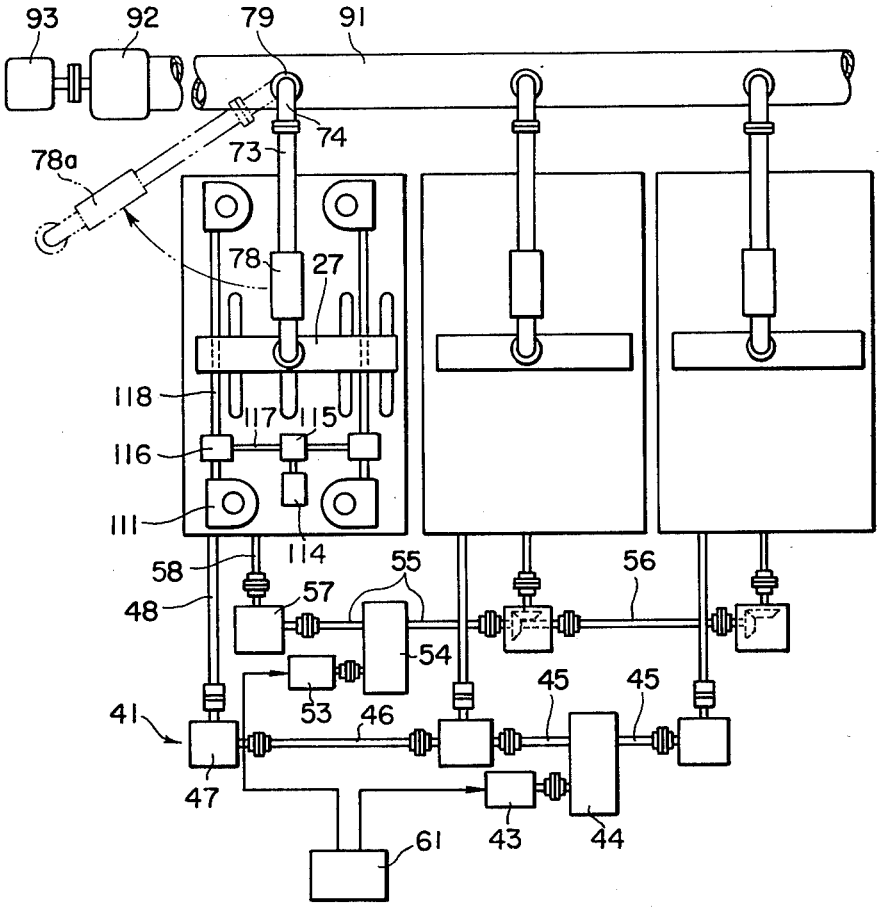

As shown in FIG. 3, the external drive unit 41 for the rolls 24 and 34 has mechanically independent drive systems for the top and bottom assemblies 21 and 31. The drive system for the top assembly 21 is connected with the roll necks 49 of the rolls 24 of the top assembly 21 through a drive motor 43, reduction gear 44, transmission shafts 45 and 46, distribution gear boxes 47 and universal spindles 48. The drive system for the bottom assembly 31 likewise is connected with the roll necks 59 of the rolls 34 of the bottom assembly 31 through a drive motor 53, reduction gear 54, transmission shafts 55 and 56, distribution gear boxes 57 and spindles 58. The drive motors 43 and 53 can be synchronously or asynchronously operated by means of a control device 61.

As shown in FIGS. 2 and 3, the header pipe 27 is connected with a water supply main 91 through a flange 71, water feed pipes 72–77, flexible pipe fittings 78 and 79, and control valve 80.

The flexible fittings 78 and 79 permit bending of the water feed pipes when the top frame 22 moves up and down. The flexible fitting 79 also has a rotatable and bendable ball joint.

The header 37 leading to the bottom nozzles 35 is connected with the water supply main 91 through water feed pipes 81–83, a flange 84, and control valve 87. The control valves 80 and 87 regulate the ratio of the top and bottom flow rates and the flow rates of the individual cooling units.

The water supply main 91 is connected with a pump 92 to supply a coolant under pressure. The pump 92 is driven by a motor 93.

Figure 5:
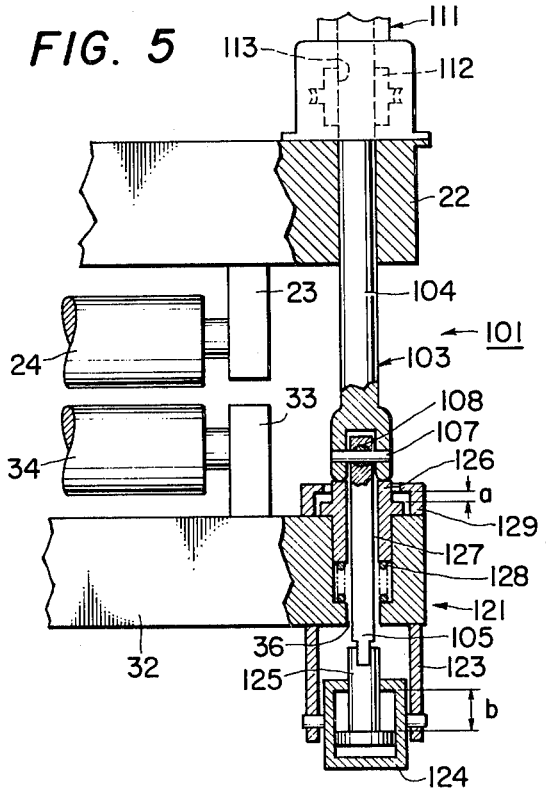
FIG. 5 is a partial cross-sectional front view of a coupling device used in said apparatus.

Each coupling device 101 comprises, in the embodiment of FIG. 5, a coupling rod 103, a screwdown mechanism 111 and a restraining force control device 121. As shown in FIGS. 1 and 2, a pair of the coupling devices 101 are provided on both sides of the delivery line. And a plurality of such pairs (e.g. two pairs in this embodiment) are provided for each of the cooling units 15, 16 and 17 along the delivery line. In each of the cooling units 15, 16 and 17, the top and bottom assemblies 21 and 31 are coupled together at both ends by said coupling devices 101. The coupling rod 103 comprises a top rod portion 104 and a bottom rod portion 105.

The screwdown mechanism 111 is provided in a suitable position on the top frame 22. As shown in FIG. 5, a worm wheel 112 contained in said screwdown mechanism 111 and that part of the top rod portion 104 which projects beyond the top frame 22 are threadedly coupled by threads 113. The top frame 22 is thereby freely movable up and down.

All the screwdown mechanisms 111 on one top frame are driven together by a drive motor 114 through distribution gear boxes 115 and 116 and drive shafts 117 and 118, as illustrated in FIG. 3. Alternatively, the screwdown mechanisms 111 can be mounted to the bottom frame 32.

The restraining force control device 121 as shown in FIG. 5 comprises a hydraulic cylinder 124 mounted on the bottom frame 32 by a bracket 123, a support guide 126 to support the weight of the upper structure, and a spring 128 to balance said weight. The spring 128 may be omitted, in which case the load is supported by the cylinder 124 only. The support guide 126 is vertically displacably mounted in the bottom frame 32, and has, in its center, an opening 127 through which the bottom rod portion 105 passes. The top end of said support guide 126 contacts the bottom end of the top coupling rod portion 104 to support the downward load. The bottom end of the support guide 126 is positioned within the frame 32, where it contacts the top end of the spring 128. Therefore, the support guide 126 is urged upwardly by the force of the spring 128. Since the amount of vertical movement of the support guide 126 is limited to the distance a by a stop 129 engaged by the flange on the support guide 126, the spring 128 expands and contracts only within the distance a. The bottom rod portion 105 passes through the support guide 126, the spring 128 and an opening 36 in the bottom frame 32. The top end thereof is pivotally connected to the top rod portion 104 by means of a pin 107 and spherical bushing 108. The bottom end is connected with a rod 125 of the hydraulic cylinder 124 through a coupling member of suitable shape, so that the pushing and pulling force of the hydraulic cylinder 124 be transmitted through the bottom rod portion 105 to the top rod portion 104. Accordingly, when the top roll 24 is pushed upward by an external force, e.g. plate deformation, the top rod portion 104 is raised through the bearings 23, top frame 22 and screwdown mechanism 111. Therefore, the bottom rod portion 105 and the rod 125 of the cylinder 124 coupled to the top rod portion 105 by the coupling pin 102 are also raised. At this time, the support guide 126 moves upward a maximum distance a. Within this distance, the reaction force of the spring 128 acts upwardly on the top rod portion 104 assisting the external force. However, the net plate restraining force exerted by the cylinder 124 on the top roll 24 increases as the spring force decreases. Once the support guide 126 reaches the stop 129, thereafter only the cylinder 124 acts, and the bottom rod portion 105 is raised to the end of the cylinder 124. Accordingly, adjustment of plate restraining force and control of the maximum restraining force can be accomplished by regulating the pressure in the cylinder 124. Although the above-described embodiment contains the spring 128, the restraining force may be controlled by the cylinder 124 alone, as mentioned previously.

The top and bottom rod portions 104 and 105 are flexibly coupled so as to accommodate an inclination of the top frame 22 in any direction. The bottom rod portion 105 is guided in its movement by the support guide 126. The spherical bushing by which the bottom rod portion 105 is connected with the top rod portion 104 permits the tilting of said top rod portion 104 relative to the bottom rod portion. Further, the contact surface between the top rod portion 104 and the support guide 124 is cylindrically shaped in the direction of plate travel so as to support the thrust load in that direction.

Figure 6:
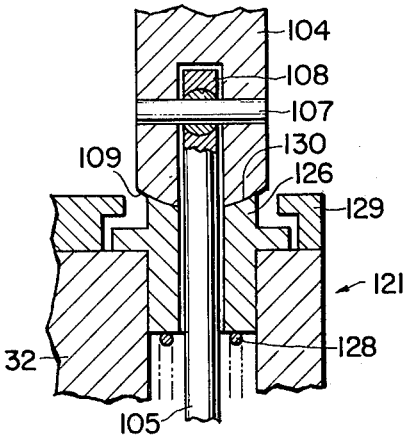
FIG. 6 is an enlarged cross-sectional view showing details of a restraining-force adjusting device in the coupling device shown in FIG. 5.
Figure 8:
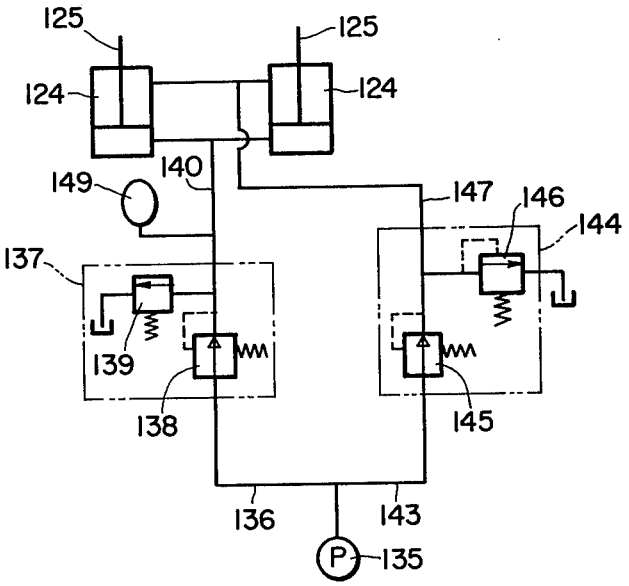
FIG. 8 is a hydraulic circuit diagram of a device for controlling the hydraulic pressure acting on the cylinder of the restraining-force adjusting device.
Figure 9:
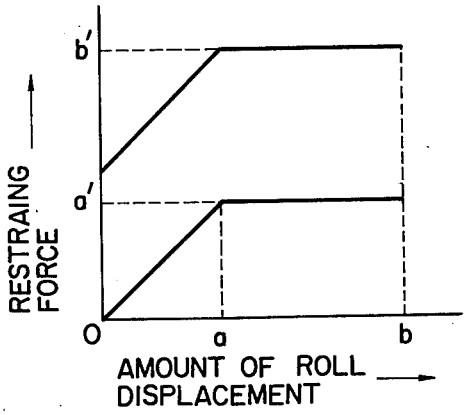
FIG. 9 is a graphical representation of the relation between the restraining force and the amount of roll displacement.

As shown in FIG. 6, it is also possible to have the bottom frame 32 support a thrust load in any direction through the support guide 126, by making the contact surfaces 109 and 130 spherical surfaces. This makes is possible to dispense with a thrust receiving support guide between the top and bottom frames 22 and 32. There is another advantage. If the cylinder 124 imposes a tension load on the top rod portion 104 through the bottom rod portion 105, the reaction force is received by the top end 130 of the support guide 126, thus eliminating any rattling of the pin 107 in the coupling section. This increases the accuracy of roll space setting and eliminates variations in the restraining force, which in turn assures the production of precisely sized flat steel plates and sheets.

Figure 7:
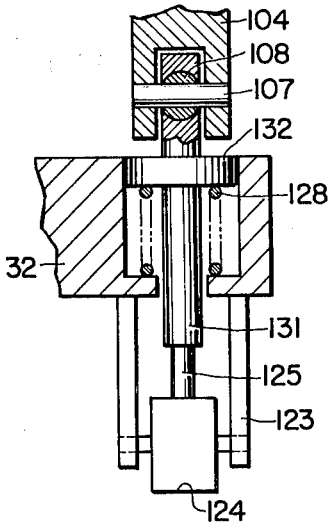
FIG. 7 is a cross-sectional view showing another embodiment of the restraining-force adjusting device.

In another embodiment, the support guide and bottom rod can be integrally constructed as shown in FIG. 7. The bottom rod portion 131 has a flange 132 thereon, and the spring 128 is interposed between said flange 132 and the bottom frame 32. In this case, the thrust load is received by the coupling pin 107. In consideration of the strength of the rod and pin, it is then desirable to provide a thrust guide device (not shown) between the top and bottom frames 22 and 32.

In the illustrated embodiment, three cooling units are provided. But the manner of cooling units depends on the handling capacity required. The weight of each cooling unit must be held below the lifting capacity of the plant crane. Thus the top and bottom assemblies, each weighing less than the crane's lifting capacity, may be detached and separately handled.

Further, as shown in FIG. 1, a drying device 151 may be provided at the exit end of the cooling apparatus 11. The drying device 151 has a gas nozzle 152 that is positioned immediately after the exit end of the cooling apparatus 11 and immediately above the delivery line of the plate 1. The gas nozzle 152 has many nozzle holes 153 which are arranged across the delivery line so as to eject air or other non-reactive gas over the entire width of the top surface of the plate 1. Preferably compressed air for drying is supplied from an air compressor (not shown) through a feed pipe 154 to the air nozzle 152. This drying device 151 removes water from the top surface of the as-cooled plate 1, thereby preventing the occurrence of rust and deformation. No drying device is necessary for the bottom surface, since water on the bottom surface falls off spontaneously.

The operating method and operation of the above-described cooling apparatus will now be described.

By turning the worm wheels 112 by a screwdown device not shown, the top frames 22 are moved up and down to obtain a roll spacing slightly smaller, preferably 2 to 3 mm, than or equal to the thickness of the plate to be cooled. The required restraining force is established by adjusting the pressure of the hydraulic fluid in the cylinders 124. The length of the cooling path is determined by the feeding speed, plate thickness and other factors. The length in turn determines the number of the cooling units from among the total number of cooling units in the apparatus to be employed. The roll spacing of the unemployed cooling units is increased until it is larger than the plate thickness, so that these unemployed units serve simply as delivery tables. Water in the unemployed cooling units is shut off by means of the flow control valve 80 or other valve. The top and bottom roll drive motors 43 and 53 are so set as to be electrically interlocked. On completion of these preparatory steps, the plate 1 to be cooled is fed into the apparatus in the direction from the entry-side table 3 to the delivery-side table 5 for being cooled.

The apparatus can be used without quenching, i.e. serving simply as an in-line unit to feed plain-carbon steel plates or as a simple air-cooling unit. In such a case, the apparatus functions as a mere delivery table without performing forced cooling. In such cases, the top assembly 21 is raised to its upper limit, the top and bottom roll drive motors 43 and 53 are electrically desynchronized, and only the bottom drive motors 53 are electrically set to drive the bottom rolls 34 that function as a mere delivery table. All cooling water is shut off.

For changing a cooling unit, the cooling water piping is disconnected at the flanges 71 and 84. The upper piping system is lifted by the plant crane after turning aside the pipe 73 and fitting 78, as indicated at **78*a* in FIG. 3. The top and bottom assemblies 21 and 31 can be changed by disconnecting the couplings of the spindles 48 and 58 to the rolls. When changing both top and bottom assemblies 21 and 31, they may be lifted together. By removing the connecting pins 107 only the top assembly 21 can be removed, or the top assembly 21 can be removed first and the bottom assembly 31** next.

A device for imposing a uniform restraining force on a plate being cooled will now be described. This device is contained in said restraining force control device 121.

The restraining force imposed on the plate 1 is obtained mainly from the weight of the top assembly 21 that comprises the top roll 24, top frame 22 and so on. Further, the restraining force is adjusted by the cylinder 124 through the coupling rod 103. To impose a uniform restraining force on the entire area of the plate, it is desirable that the load be distributed equally to all the coupling rods 103. But such an arrangement is difficult from a practical standpoint because of the necessity to provide the cooling nozzles and the location of the drive spindles 48.

When treating narrow plates, such as those having a width less than half the length of the rolls, the top roll 24 tends to be inclined about the edge of the plate near the center of the rolls if the restraining force on the work and drive sides of the apparatus is equal. The work side is the side at the opposite end of the rolls from the end at which they are driven, i.e. the upper end of FIG. 3. As a consequence, the flow of cooling water may vary in the direction of the width of the plate. The resulting unbalanced cooling and restraining may give rise to distortion and walking of the plate being threaded.

Figure 10:
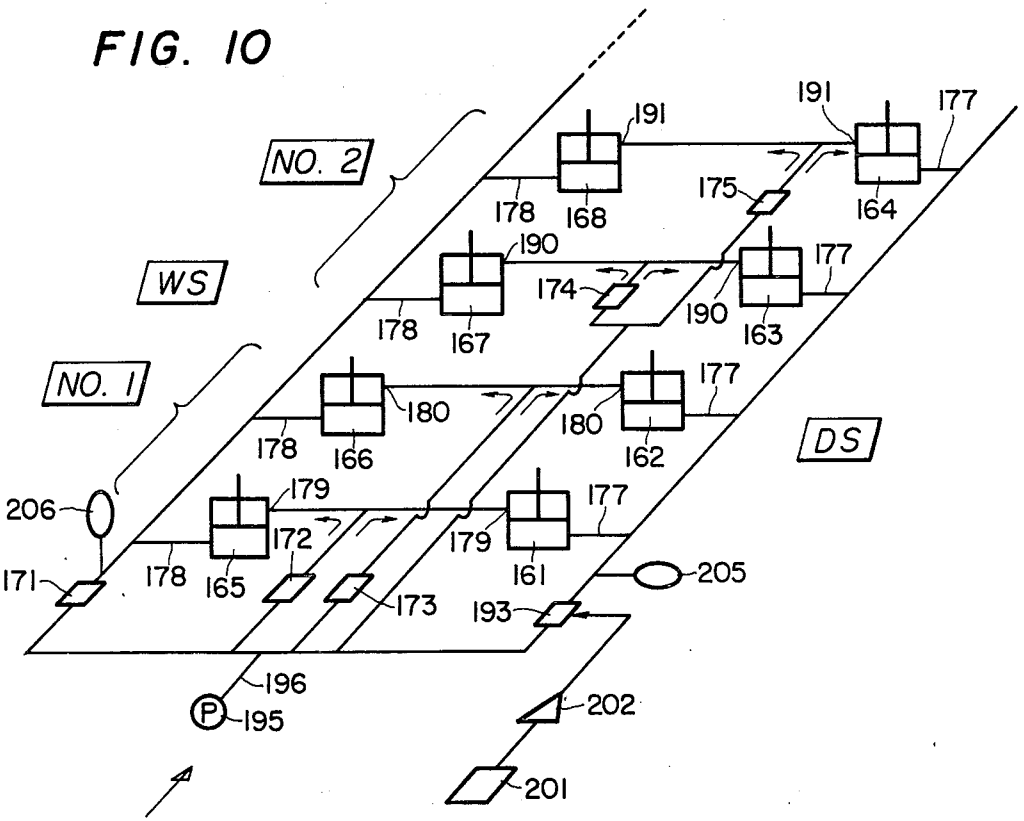
FIG. 10 is a hydraulic circuit diagram of a device for imposing a uniform restraining force on the plate being cooled by adjusting the hydraulic cylinder pressure of the restraining-force adjusting devices provided on both sides of a plurality of cooling units.

According to this invention, however, a pressure control device is provided for each of the cylinders 161 through 168, as shown in FIG. 10. The unevenly distributed weight can be corrected by adjusting the pressure on the rod ends of the cylinders, and the restraining force on the work and drive sides can be adjusted as desired by adjusting the pressure on the head ends of the cylinders. Further, a control device to adjust the overall restraining force to the desired level is also provided. To be more precise, reference numerals 161 through 164 and 165 through 168 designate hydraulic cylinders. Manually set pressure control valves 171–175 are connected in the hydraulic fluid supply pipes 178–191 therefor and a remotely controllable pressure control valve 193 is provided in hydraulic fluid supply pipes 177. The pressure control valves are usually pressure reducing and relief valves. An unbalanced load is corrected by individually adjusting the rod-end pressures in the cylinders 161 and 165 by the control valve 172, in the cylinders 162 and 166 by the control valve 173, in the cylinders 163 and 167 by the control valve 174, and in the cylinders 164 and 168 by the control valve 175, by use of a hydraulic pressure supplied from a pressure supply 195 through a feed pipe 196. This circuit is for a case wherein the load on the work and drive sides is equal. When the load is distributed unevenly, a pressure control valve can be provided for each cylinder to adjust the individual pressure therein. When the required restraining force is greater than the weight of the top assembly, the deficiency in the force can be overcome by applying the necessary pressure in the rod-end of each cylinder. Conversely, when the weight is greater than the required restraining force, the largest rod-end cylinder pressure can be used as a reference for the adjustment of the other cylinder pressures. By thus equalizing the forces working on the individual cylinder rods, then adjusting the head end cylinder pressures on the drive and work sides of the apparatus by the pressure control valves 193 and 171, respectively, the forces on the work and drive sides can be properly adjusted. For instance, the restraining force on the work side can be changed by changing the pressure on the work side while keeping the pressure on the drive side unchanged, whereby an appropriate restraining force for each specific plate width can be selected. The restraining force may be distributed between the work and drive sides according to the ratio of moments, by assuming that the fulcrum lies at the center of the plate width.

The pressure control valve 193 can be a servo-valve. A proportional magnetic or electrically operated pressure control valve, which are less expensive than a servo-valve, also can satisfactorily serve the purpose. The pressure control valve 193 is controlled by electrically connecting it with a pressure setter 201, that issues setting signals manually or by means of computer, and a converter 202 that converts the setting signals into valve-controlling currents or voltages. By directly connecting the pressure setter 201 with an on-line control computer, a pressure suited for each plate width can automatically be established.

The head-side pressure control valve 171 on the work side is a manually actuated valve. By providing such a control valve on the work side as well as the drive side, it becomes possible to control the overall restraining force. For instance, the restraining force can be controlled to a proper level, depending on the plate thickness.

When a proportional magnetic pressure control valve is used, the established pressure becomes unstable in the low pressure range (generally under 10 kg/cm$^2$). By preliminarily correcting the rod-end pressure in the cylinders, however, the established pressure can be raised to above 10 kg/cm$^2$ and the pressure setting accuracy improved.

Reference numerals 205 and 206 designate accumulators. Said accumulators absorb surge pressure and correct for any response delay that occurs when the reducing and relief valves operate as the cylinder rods are pushed and pulled by external forces. By reducing the pressure variation on the head ends of the cylinders, a constant restraining force can be obtained.

In the above-described embodiment, the cylinders are provided on the bottom frame. But they may also be provided on the top frame, with an oppositely disposed pressure control circuit.

Further, the apparatus of this invention may be used not only as just a plate-cooling unit, but also as a direct-quenching unit by installing it immediately after a rolling mill train.

Constructed as described above, the apparatus of this invention brings about many desirable results as follows:

(1) The in-line plate cooling apparatus in general is required to have good maintainability, since a shutdown thereof due to failure or other reasons affects the productivity of the entire plant. Since the apparatus of this invention has replaceable units, it requires only a short downtime for replacement of a unit or units. Repair and maintenance of the removed units can then be performed while the plant continues to operate.

(2) A combination of such units permits one-pass treatment, adjustment of individual restraining forces, and selection of the desired length of the cooling path.

(3) A choice of efficient drive modes suited for different applications is possible, since independent drive of the bottom rolls and interlocked drive of the top and bottom rolls can be accomplished easily. This reduces the cost of running the apparatus and increases equipment life. Besides, even if the diameters of the top and bottom rolls become different, their speeds can be adjusted readily.

(4) The use of a gear drive system increases equipment reliability and permits high-speed treatment as compared with the conventional chain drive system which involves problems of high-speed treatment and equipment reliability.

(5) The plate enters between the rolls with ease, since the roll spacing can be held a value only slightly less than the plate thickness.

(6) Even if an extraordinary distortion occurs during handling of the plates, the maximum restraining force can be adjusted by the cylinder output power. Such distortion can be sufficiently accommodated by making the cylinder stroke long enough to cover the expected maximum roll displacement. Since the rolls and other members are thus kept free of extraordinary loads, safe operation is insured.

(7) By adjusting the cylinder pressures on both sides of the apparatus, restraining forces on the work and drive sides can be individually be adjusted, and a suitable restraining force selected at will. This permits correcting the unbalanced distribution of the weight of the apparatus, and, therefore, the placing of a uniform restraining force over the entire area of the plate being handled. Also, even for narrow plates, walking can be eliminated and a uniform restraining force can be applied across the entire plate width.

(8) Since the top roll assembly is tiltable, a plate having a distortion at its front end can enter the cooling line with ease.

(9) Since the unbalanced weight distribution among the individual coupling rods is correctable, a uniform restraining force can be imposed on the plate, both widthwise and lengthwise.

(10) Since the top roll assembly is made in small sections, the top rolls can easily follow the moving top surface of the plate. This permits a precision-control of the top and bottom surface cooling conditions, which in turn reduces the deformation of plates.

What is claimed is:

1. Apparatus for cooling hot steel plate and sheet, which comprises:

a base provided in line with a plate and sheet rolling mill and extending along the delivery line of the plate;

a plurality of cooling units detachably mounted on said base in the direction of the delivery line, each cooling unit having a top roll-and-nozzle assembly, a bottom roll-and-nozzle assembly, and a plurality of coupling devices for coupling said assemblies, said top roll-and-nozzle assembly having a top roll frame, a plurality of top rolls rotatably mounted on said frame and extending across the plate delivery line and a plurality of top cooling nozzles disposed between said top rolls, said bottom roll-and-nozzle assembly having a bottom roll frame, a plurality of bottom rolls rotatably mounted on said frame and extending across the plate delivery line and a plurality of bottom cooling nozzles disposed between said bottom rolls, said units of top and bottom roll-and-nozzle assemblies each having a length for holding only a portion of the length of plate or sheet being passed through said apparatus between the pairs of said top and bottom rolls, and each pair of said top and bottom cooling nozzles being opposed to each other, said coupling devices being disposed symmetrically with respect to the plate delivery line, and each coupling device being connected between said top and bottom roll frames and having a first and second coupling rod portion detachably connected to each other, rod moving means connected to said first coupling rod portion for raising and lowering the roll-and-nozzle assembly to which it is connected, and restriction balance adjusting means connected to said second coupling rod portion for imparting upward and downward force to said individual coupling devices to raise and lower said top rolls in accordance with a change in the shape of the plate or sheet being passed between said top and bottom rolls for causing said top roll-and-nozzle assembly to apply substantially uniform restraining force to the surface of the plate or sheet that is contacted by the top rolls;

drive means connected to said top and bottom rolls for rotating said rolls; and means connected to said cooling nozzles for supplying a coolant under pressure to said cooling nozzles.

2. An apparatus as claimed in claim 1 wherein there are four sets of top and bottom rolls in each cooling unit.

3. An apparatus as claimed in claim 1, wherein said roll device comprises mutually independent top and bottom roll drive units and a device connected to said roll drive units for synchronizing and asynchronizing said drive units, each drive unit having gears fixed to one end of the rolls, intermediate gears interposed between said gears on adjacent rolls, a drive spindle connected to one of the rolls in said top and bottom roll-and-nozzle assemblies, a distribution gear box to which said drive spindle is connected, and a drive motor connected to said distribution gear box through a reduction gear, whereby only the bottom rolls are rotated when material not requiring cooling is passed and the top and bottom rolls are synchronously rotated when material requiring cooling is passed.

4. An apparatus as claimed in claim 1, wherein said moving means comprises a worm-gear transmission mechanism connected to said first coupling rod portion and a drive motor connected to the transmission mechanisms of all said first coupling rod portions and said force applying means comprises a cylindrical support guide slidably mounted in the roll frame to which said second coupling rod portion is connected, said support guide contacting one end of said first coupling rod portion at one end thereof and having said second coupling rod portion extending slidably therethrough, a coil spring positioned between said support guide and said roll frame and urging said support guide toward said first coupling rod portion, a hydraulic cylinder mounted on the frame in which said support guide is mounted and having a piston rod the free end of which is connected to said second coupling rod portion, a liquid supply means coupled to said hydraulic cylinders for all said second coupling rod portions for feeding a hydraulic liquid to said hydraulic cylinders, and means for adjusting the liquid pressure interposed between said hydraulic cylinders and said liquid supply.

5. An apparatus as claimed in claim 4, wherein said first and second coupling rod portions are pivotally connected by a pin for pivotal movement in the direction of the length of the plate delivery line, and the contacting end surfaces of said second coupling rod portion and said support guide are complementary convex and concave spherical surfaces.

6. An apparatus as claimed in claim 4, wherein said first and second coupling rod portions are pivotally connected by a pin for pivotal movement in the direction of the length of the plate delivery line, and the contacting end surfaces of said second coupling rod portion and said support guide are complementary convex and concave cylindrical surfaces.

* * * * *